US006085497A

United States Patent [19]

Natterer

[11] Patent Number: 6,085,497

[45] Date of Patent: Jul. 11, 2000

[54] LIFTING DEVICE FOR A WORKING STATION OF A PACKAGING MACHINE

[75] Inventor: Johann Natterer, Legau, Germany

[73] Assignee: Multivec Sepp Haggenmuller GmbH & Co., Wolfertschwenden, Germany

[21] Appl. No.: 09/131,029

[22] Filed: Aug. 7, 1998

[30] Foreign Application Priority Data

Aug. 8, 1997 [DE] Germany ..... 197 34 513

[51] Int. Cl.[7] ..... B65B 31/02

[52] U.S. Cl. ..... 53/559; 53/373.7; 53/579

[58] Field of Search ..... 53/559, 453, 478, 53/456, 579, 578, 575, 373.7, 374.3, 374.8, 375.4, 375.6, 373.2

[56] References Cited

U.S. PATENT DOCUMENTS

| | | | |
|---|---|---|---|
| 3,343,336 | 9/1967 | Bradford | 53/329 |
| 3,808,772 | 5/1974 | Turtschan | 53/141 |
| 3,958,394 | 5/1976 | Mahaffy et al. | 53/559 X |
| 4,064,676 | 12/1977 | King et al. | 53/559 X |
| 4,094,127 | 6/1978 | Romagnoli | 53/559 X |
| 5,517,805 | 5/1996 | Epstein | 53/453 |
| 5,819,510 | 10/1998 | Bochtler et al. | 53/559 |

FOREIGN PATENT DOCUMENTS

| | | |
|---|---|---|
| 430641 | 11/1972 | Australia . |
| 0 569 937 A1 | 11/1993 | European Pat. Off. . |
| 0 847 920 | 6/1998 | European Pat. Off. . |
| 2 637 253 | 4/1990 | France . |
| 329 455 | 7/1975 | Germany . |
| 42 16 210 A1 | 11/1993 | Germany . |
| 44 36 407 A1 | 4/1996 | Germany . |
| 49-16586 | 2/1974 | Japan . |
| 8-217007 | 8/1996 | Japan . |

*Primary Examiner*—James F. Coan
*Attorney, Agent, or Firm*—George W. Neuner

[57] ABSTRACT

A working station of a packaging machine comprises a first tool member and a second tool member which can be lowered to a lowered position relative to the first tool member and lifted to a raised position relative to the first tool member. Both tool members are disposed on opposite sides of a material web conveyed through the packaging machine. A lifting device comprises a first lifting member for moving the second tool member relative to the first tool member and a second lifting member coupled to the second tool member for moving the first tool member away from the material web when lowering the second tool member into the lowered position.

7 Claims, 5 Drawing Sheets

LIFTING DEVICE FOR A WORKING STATION OF A PACKAGING MACHINE

BACKGROUND OF THE INVENTION

The invention relates to a lifting device for a working station of a packaging machine, the packaging machine having a frame and means for conveying a material web therealong, and the working station having a base, a first tool member rigidly connected to the base and disposed on one side of the material web, and a second tool member disposed on the opposite side of the material web.

The packaging machine comprises working stations for various functions such as forming, filling, sealing and cutting. A working station conventionally comprises a lower tool member and an upper tool member clamping a packaging web therebetween when in working position for carrying out an operation. Usually the upper tool member is stationary and the lower tool member may be moved up and down relative to the upper tool member by means of a lifting device. After carrying out a working operation in the respective working station the lower member is lowered and the packaging web is advanced so that the processed packages can be removed from the working station and conveyed to the following working station.

If the packages to be conveyed extend only in direction towards the lower tool member, this being the case with cups which are closed with a cover film after being filled with a product, the transport from one station to the next station is without problems. However, if the packages also extend upwards in direction of the upper tool member, this being the case if, for example, a filled-in product extends beyond the plane of the material web, such packages can not be easily introduced into the following working station.

OBJECTS OF THE INVENTION

It is the object of the invention to provide an improved lifting device for a working station of a packaging machine. It is a further object of the invention to provide a lifting device for the working station of a packaging machine allowing arbitrarily formed packages to be moved in and out from the working station in an easy manner.

SUMMARY OF THE INVENTION

In order to achieve the above-mentioned objects the invention provides a lifting device for a working station of a packaging machine, the packaging machine having a frame and means for conveying a material web therealong, and the working station having a base, a first tool member rigidly connected to the base and disposed on one side of the material web, a second tool member disposed on the opposite side of the material web, the lifting device comprising a first lifting member for lowering the second tool member into a lowered position relative to the first tool member and for lifting the second tool member into a raised position relative to the first tool member, the first lifting member being arranged between the base and the second tool member, and a second lifting member coupled to the second tool member and the first tool member for moving the first tool member away from the material web when lowering the second tool member into the lowered position, the second lifting member comprising at least one lever having a fulcrum linked to the frame via a first connection rod, one outer end pivotally connected to the base and another outer end linked to the second tool member via a second connection rod.

BRIEF DESCRIPTION OF THE DRAWINGS

Further advantages, features and objects of the invention will be apparent from the following description of an exemplary embodiment with reference to the drawings. In the drawings.

DESCRIPTION OF THE PREFERRED EMBODIMENT

Figure 1:
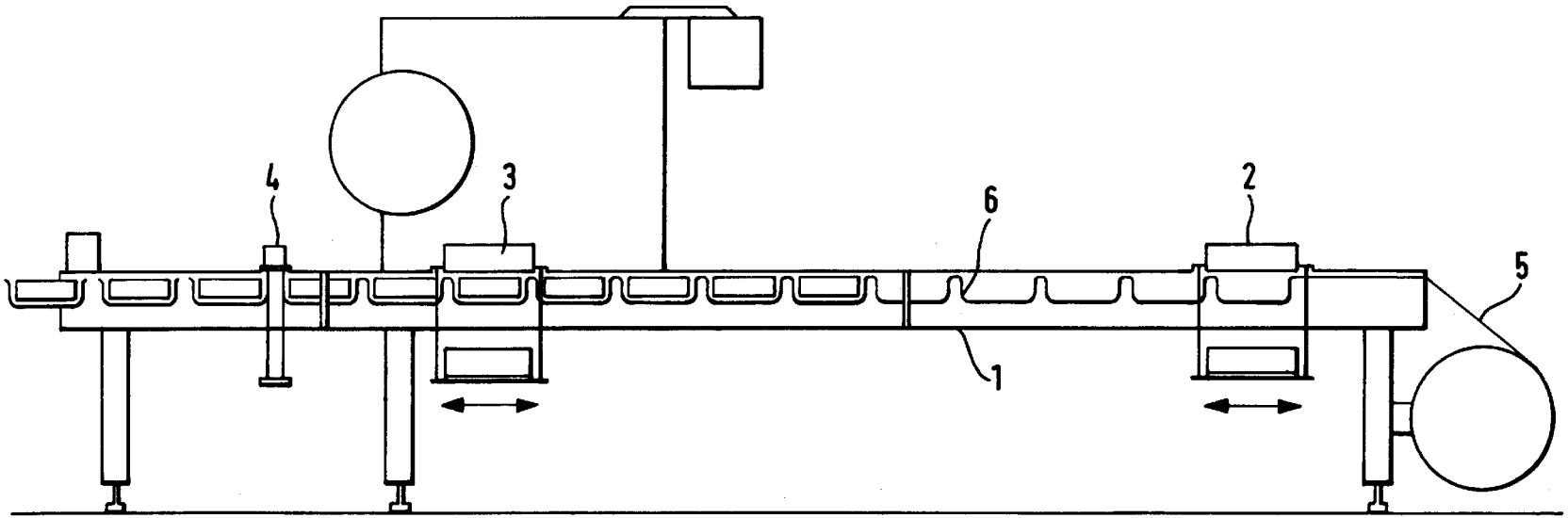
FIG. 1 is a side view of a packaging machine whereby the lateral coverings are omitted.

As shown in FIG. 1 the packaging machine comprises a machine frame 1 and a forming station 2, an evacuation and sealing station 3 and a cutting device 4 disposed successively thereon. In the packaging machine a film sheet 5 is supplied to the inlet side. In the forming station the film sheet is molded to form containers 6. After filling the containers in a filling station not shown in the figure the containers are sealed with a cover film in the evacuation and sealing station 3 and finally separated from each other by means of the cutting device 4. The machine frame 1 also comprises a guide for a not shown chain drive for conveying the film sheet 5 or the packaging containers 6 molded therein, resp.

As best shown in the FIGS. 2 to 5 a working station, shown as evacuation and sealing station 3 in an exemplary manner comprises a base 7, an upper tool member 8 rigidly connected thereto and a lower tool member 9 movable relative to the upper tool member. The base 7 and the upper tool member 8 of the working station are connected to each other by means of guide rods 10.

Figure 2:
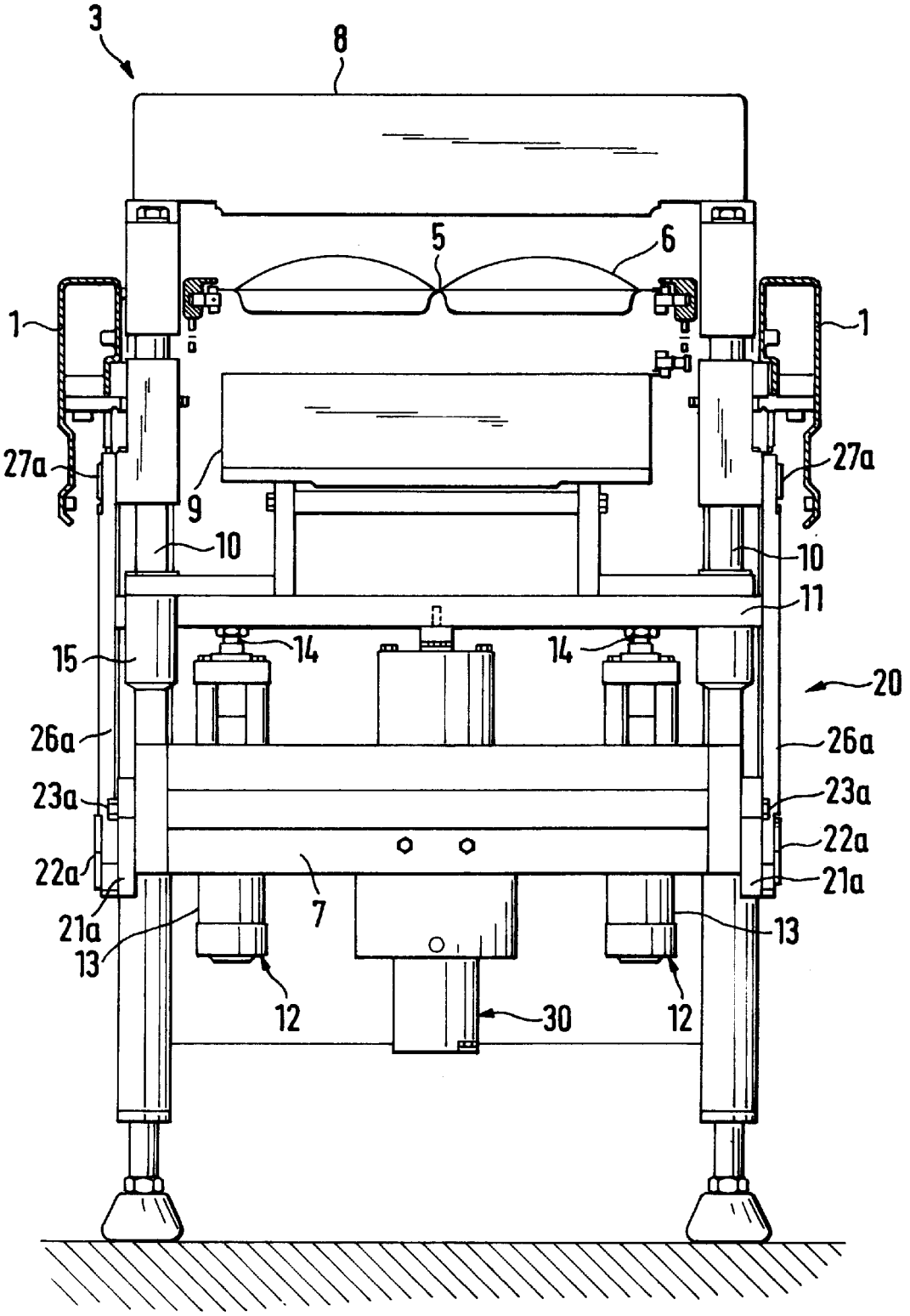
FIG. 2 is a longitudinal view of a working station seen in transport direction of the packages, in open state.
Figure 3:
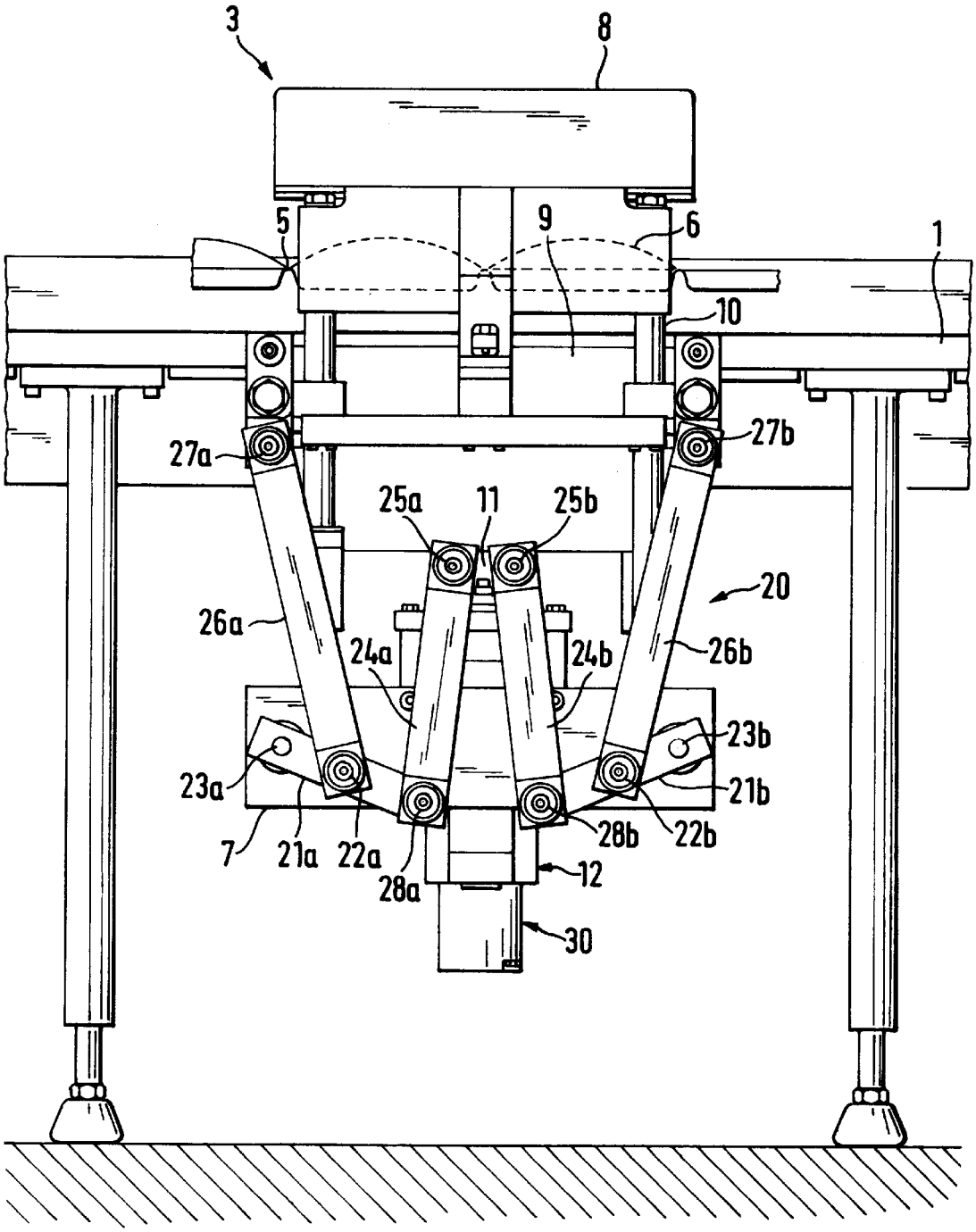
FIG. 3 is a side view of the working station of FIG. 2 in a direction perpendicular to the transport direction of the packages.
Figure 4:
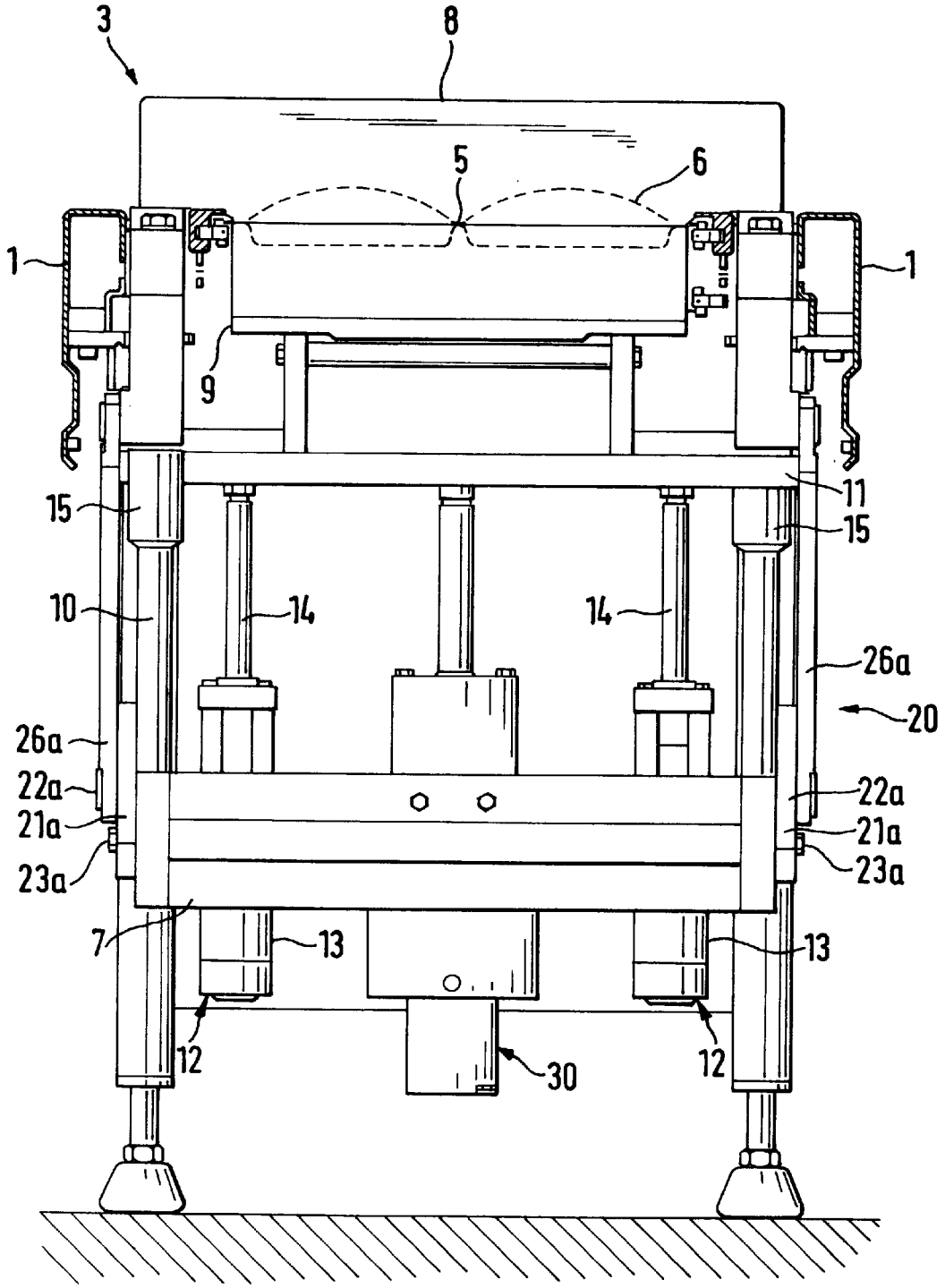
FIG. 4 is a longitudinal view of the working station of FIG. 2 in transport direction, shown in closed state.
Figure 5:
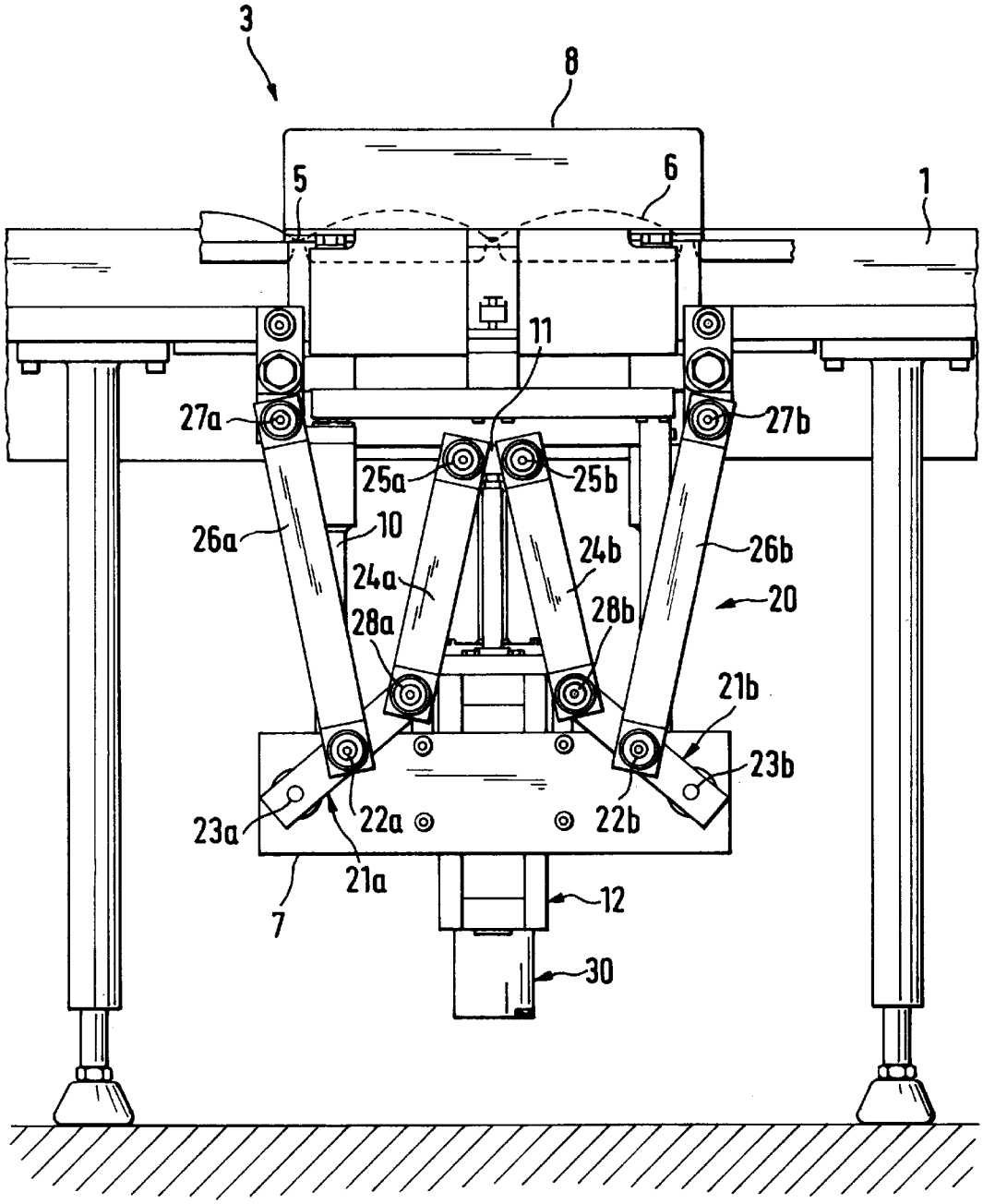
FIG. 5 is a side view of the working station of FIG. 4 in a direction perpendicular to the transport direction.

A lifting device is provided for moving the lower tool member 9 relative to the upper tool member 8 from an open position shown in the FIGS. 2 and 3 into a closed position shown in the FIGS. 4 and 5, wherein the lower tool member 9 cooperates with the upper tool member 8. The lifting device comprises two piston-cylinder devices 12 connected through a cross-piece 11. The cylinders 13 of both piston-cylinder devices 12 are each connected to the base 7, whereas the piston rods 14 are each connected to the cross piece 11 which carries the lower tool member 9. The cross piece 11 and the lower tool member 9 mounted thereto are connected to guide sleeves 15 sliding along the guide rods 10.

The piston-cylinder devices 12 are adapted to move the lower tool member 9 from the open position into the closed position and vice versa in a first closing travel over a long lifting stroke in the order of up to more than 200 mm.

As in particular shown in FIG. 2 and FIG. 4 the working station 3 has a corresponding lever system 20 arranged between the movable lower tool member 9 and the machine frame 1 on both longitudinal sides of the working station. The FIGS. 3 and 5 depict a longitudinal view of the working station 3 which best shows the construction and operation of the lever system 20.

The lever system 20 comprises two double levers 21*a*, 21*b*. The fulcrum 22*a*, 22*b* of each lever 21*a*, 21*b* is linked to a corresponding link point 27*a*, 27*b* of the machine frame 1 through corresponding connection rods 26*a*, 26*b* which are pivotally supported at the link points 27*a*, 27*b*. The one free end of each lever 21*a*, 21*b* is pivotally connected to the base 7 through a corresponding pivot joint 23*a*, 23*b*. The other free end of each lever 21*a*, 21*b* is connected to the cross piece 11 through corresponding connection rods 24*a*, 24*b*. Both the link points 25*a*, 25*b* of the rods to the cross piece 11 and the link points 28*a*, 28*b* of the rods to the levers are pivot joints.

The lenght of the levers and of the connection rods are chosen as a function of the geometrical conditions at the working station and in particular of the lifting stroke for moving the lower tool member 9 towards the upper tool member 8, and as a function of the desired lift for raising the entire lifting device when moving the lower tool member 9 into the open position.

The operation of the inventive lifting device is as follows. Before starting a working operation the working station is in the open position shown in the FIGS. 2 and 3 whereby the upper tool member 8 is spaced from the lower tool member 9. To initiate the working operation the piston-cylinder devices 12 are activated whereby the lower tool member 9 makes a first closing travel with a lift stroke of up to more than 200 mm towards the upper tool member 8. Since the base 7 is rigidly connected to the upper tool member 8 and the piston-cylinder devices 12 move the lower tool member 9 vertically upwards relative to the base 7, the lower tool member 9 approaches the upper tool member 8 until both tool members 8, 9 cooperate in the closed position of the working station shown in the FIGS. 4 and 5. In this position the lower edge of the upper tool member contacts the film sheet 5.

After having executed the working operation the lower tool member 9 is moved back into the open position according to FIGS. 2 and 3. When lowering the lower tool member 9 into the open position of the working station the connection rods 24*a*, 24*b* transmit the downward movement of the lower tool member 9 and of the cross piece 11 connected thereto, resp., to the ends of the levers 21*a*, 21*b* linked to the corresponding connection rods 24*a*, 24*b* whereby the levers 21*a*, 21*b* are both rotated around their fulcrum 22*a*, 22*b*. This results in a corresponding upward movement of the outer ends of the levers 21*a*, 21*b* connected to the base 7 whereby the base 7 is raised relative to the frame 1 and therefore relative to the film sheet 5. Since the upper tool member is rigidly connected to the base it is moved away from the film sheet. Thus, packages 6 having an upward and downward extension do not strike the lower edge of the upper tool member 8 and can be conveyed on without problems. When again raising the lower tool member 9 into the working position the levers 21*a*, 21*b* are rotated in opposite direction whereby the base 7 and the upper tool member 8 connected thereto are lowered again.

According to a further embodiment the lifting device comprises, in addition to the piston-cylinder devices 12, a power lifting member 30 serving the purpose of producing a high closing force between the lower tool member 9 and the upper tool member 8 to receive the effective forces acting during the working operation in closed position of the working station. After terminating the first closure travel of the lower tool member 9 towards the upper tool member 8 using the piston-cylinder devices 12 the high closure force is produced over a second closure travel produced by the power lifting member 30 and having a short lift stroke in relation to the first closure travel. The power lifting member 30 comprises a drive and a mechanical transmission device which is formed to have a substantially constant closing force whereby his closing force for the second closing travel is produced upon occurrence of a resistance.

While the invention has been described in preferred form it is not limited to the precise nature shown as various modifications may be made without departing from the scope and spirit of the invention.

I claim:

1. Lifting device for a working station of a packaging machine, said packaging machine having a frame and means for conveying a material web therealong, and said working station having a base, a first tool member rigidly connected to said base and disposed on one side of said material web, and a second tool member disposed on the opposite side of said material web, said lifting device comprising a first lifting member for lowering said second tool member into a lowered position relative to said first tool member and for raising said second tool member into a raised position relative to said first tool member, said first lifting member being arranged between said base and said second tool member, and a second lifting member coupled to said second tool member and said first tool member for moving said first tool member away from said material web when lowering said second tool member into said lowered position, said second lifting member comprising at least one lever having a fulcrum linked to said frame via a first connection rod, one outer end pivotally connected to said base and another outer end linked to said second tool member via a second connection rod.

2. The lifting device of claim 1, wherein said second lifting member comprises a lever system.

3. The lifting device of claim 2, wherein said frame of said packaging machine laterally defines said material web and said lever system is linked to said frame and to said second tool member.

4. The lifting device of claim 2, wherein said lever system comprises two levers linked to said first and second connection rods for rotating said levers in opposite direction when raising or lowering said second tool member.

5. The lifting device of claim 1, comprising two of said second lifting members disposed on opposite longitudinal sides of said working station.

6. The lifting device of claim 1, comprising a power lifting member for producing an increased closing force urging said second tool member towards said first tool member in said raised position of said second tool member.

7. Packaging machine having a machine frame, a working station mounted on said frame and means for conveying a material web along said frame through said working station, said working station having a base, a first tool member rigidly connected to said base and disposed on one side of said material web, and a second tool member disposed on an opposite side of said material web, and a lifting device comprising a first lifting member for lowering said second tool member into a lowered position relative to said first tool member and for raising said second tool member into a raised position relative to said first tool member, said first lifting member being arranged between said base and said second tool member, and a second lifting member coupled to said second tool member and said first tool member for moving said first tool member away from said material web when lowering said second tool member into said lowered position, said second lifting member comprising at least one lever having a fulcrum linked to said frame via a first connection rod, one outer end pivotally connected to said base and another outer end linked to said second tool member via a second connection rod.

* * * * *

UNITED STATES PATENT AND TRADEMARK OFFICE

CERTIFICATE OF CORRECTION

PATENT NO. : 6,085,497
DATED : July 11, 2000
INVENTOR(S) : Johann Natterer

It is certified that error appears in the above-identified patent and that said Letters Patent is hereby corrected as shown below:

In the Foreign Application Priority Data section, please correct the priority data as follows:

[30] Foreign Application Priority Data

GERMANY, AUGUST 8, 1997, 197 34 513.1

Signed and Sealed this

Tenth Day of April, 2001

*Attest:*

Nicholas P. Godici

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,085,497
DATED : July 11, 2000
INVENTOR(S) : Johann Natterer

It is certified that error appears in the above-identified patent and that said Letters Patent is hereby corrected as shown below:

Title page,
Please correct the Assignee name as follows:

-- [73] Assignee

Multivac Sepp Haggenmuller GmbH --

Signed and Sealed this

Thirtieth Day of October, 2001

*Attest:*

Nicholas P. Godici

NICHOLAS P. GODICI
*Acting Director of the United States Patent and Trademark Office*

*Attesting Officer*